US006452549B1

(12) United States Patent
Lo

(10) Patent No.: US 6,452,549 B1
(45) Date of Patent: Sep. 17, 2002

(54) STACKED, MULTI-BAND LOOK-THROUGH ANTENNA

(75) Inventor: Zane Lo, Merrimack, NH (US)

(73) Assignee: BAE Systems Information and Electronic Systems Integration Inc, Nashua, NH (US)

( * ) Notice: Subject to any disclaimer, the term of this patent is extended or adjusted under 35 U.S.C. 154(b) by 0 days.

(21) Appl. No.: 09/847,792

(22) Filed: May 2, 2001

Related U.S. Application Data

(60) Provisional application No. 60/201,213, filed on May 2, 2000.

(51) Int. Cl.[7] ..... H01Q 1/38; H01Q 19/00; H01Q 15/02

(52) U.S. Cl. ..... 343/700 MS; 343/756; 343/770; 343/909

(58) Field of Search ..... 343/700 MS, 846, 343/848, 767, 770, 829, 830, 756, 909

(56) References Cited

U.S. PATENT DOCUMENTS

| | | | | |
|---|---|---|---|---|
| 3,754,271 A | | 8/1973 | Epis | 343/756 |
| 4,786,914 A | | 11/1988 | Wu et al. | 343/909 |
| 4,804,965 A | | 2/1989 | Roederer | 343/700 MS |
| 4,864,314 A | | 9/1989 | Bond | 343/700 MS |
| 4,903,033 A | | 2/1990 | Tsao et al. | 343/700 MS |
| 5,262,791 A | * | 11/1993 | Tsuda et al. | 343/700 MS |
| 5,485,167 A | | 1/1996 | Wong et al. | 343/753 |
| 5,561,434 A | | 10/1996 | Yamazaki | 343/700 MS |
| 5,596,336 A | | 1/1997 | Liu | 343/770 |
| 5,661,493 A | * | 8/1997 | Uher et al. | 343/700 MS |
| 5,872,545 A | * | 2/1999 | Rammos | 343/770 |
| 5,982,339 A | | 11/1999 | Lalezari et al. | 343/872 |
| 6,025,812 A | | 2/2000 | Gabriel et al. | 343/797 |
| 6,034,637 A | | 3/2000 | McCoy et al. | 343/700 MS |
| 6,054,967 A | | 4/2000 | Wu et al. | 343/909 |
| 6,091,365 A | * | 7/2000 | Derneryd et al. | 343/700 MS |
| 6,118,406 A | * | 9/2000 | Josypenko | 343/700 MS |
| 6,147,647 A | | 11/2000 | Tassoudji et al. | 343/700 MS |
| 6,154,176 A | | 11/2000 | Fathy et al. | 343/700 MS |

* cited by examiner

*Primary Examiner*—Don Wong
*Assistant Examiner*—Hoang Nguyen
(74) *Attorney, Agent, or Firm*—Scott J. Asmus; Vernon C. Maine; Maine & Asmus

(57) ABSTRACT

The present invention features a stacked, multi-band, antenna system consisting of a low-frequency, forward portion and a gridded, rear portion designed for operation at a higher frequency. Both front and rear radiating elements may share a common ground plane or the rear element may form a ground plane for the front element. Typically, the front antenna is a relatively narrow-band, gridded, bow-tie dipole or a similar radiating structure and the rear antenna is a wide-band dipole or slot element. Additional frequency bands may be designed into the inventive system by adding additional dipole or similar antenna elements above, below, or between the front and rear antennas. By properly choosing element sizes and spacings, and orienting the various antennas, a frequency band ratio of as little as 4:1 may be obtained.

19 Claims, 7 Drawing Sheets

STACKED, MULTI-BAND LOOK-THROUGH ANTENNA

RELATED APPLICATION

This application claims priority from U.S. Provisional Patent Application, Ser. No. 60/201,213, filed May 2, 2000.

FIELD OF THE INVENTION

The present invention relates to antennas and, more specifically, to a stacked, multi-band, look-through antenna structure with a small frequency separation between operating bands.

BACKGROUND OF THE INVENTION

Applications requiring transmission and/or reception of radio frequency (RF) signals, typically in the microwave or millimeter wave bands, are numerous. Such applications include radar systems, satellite communications systems, aircraft altimeter and guidance systems, friend or foe (FOF) identification systems and ground reconnaissance mapping systems. Each of these applications requires transmitting RF energy through free space. Each system, therefore, also requires an antenna for receiving or radiating this RF energy to or from free space, the antenna acting as a transition between a wave guiding structure (i.e., a transmission line or the like) and free space. Many types of antennas exist and are well known to those skilled in the art, each of these known antennas having both advantages and disadvantages.

In many systems, both commercial and military, multiple systems or applications require simultaneous transmission and reception of RF signals. For example, aircraft typically have radar systems, ground communications, and air-to-air communications systems. In these systems, at least one antenna is used by each system. A problem arises when limited surface space, known as real estate, is available for deploying the necessary antennas. This is often the case with aircraft and almost always a problem with satellites.

In general, it is difficult to implement multiple antennas in close proximity to one another because of interference and crosstalk problems. To overcome the real estate problem, attempts have been made to combine more than one function and/or frequency of operation into a single antenna structure without incurring the aforementioned crosstalk and interference problems.

U.S. Pat. No. 4,864,314 for DUAL BAND ANTENNAS WITH A MICROSTRIP ARRAY MOUNTED ATOP A SLOT ARRAY, issued to Kevin J. Bond, teaches one such antenna. BOND discloses a primary slotted array antenna operated in the 10 GHz frequency range with a secondary antenna mounted in front of the primary antenna. This front antenna is designed to operate in the 1 GHz range and be essentially transparent to the 10 GHz signal from the rear antenna.

In contradistinction, the stacked, multi-band antenna of the present invention is designed to allow a much closer spacing of operating frequency bands, typically on the order of 4:1 not the 10:1 frequency ratio of the BOND antenna. In addition to the critical upper and lower operating frequency band separation, the BOND antenna is good for only single linear polarization of the radiated field wave, while the inventive antenna may be used in dual linear polarization and circular polarization modes.

Another approach to a multi-band antenna is disclosed in U.S. Pat. No. 5,485,167 for MULTI-FREQUENCY BAND PHASE-ARRAY ANTENNA USING MULTIPLE LAYERED DIPOLE ARRAYS; issued to Nam S. Wong, et al. In the WONG, et al. system, several layers of dipole pair arrays, each tuned to a different frequency band, are stacked relative to each other in positions to form frequency selective surfaces. The highest frequency array is in front of the next lowest array, and so forth. Due to the frequency-selective property of the arrays, incident high frequency signals are absorbed by the highest frequency array. However, low frequency signals experience only a minimal loss in passing through the higher frequency, upper antenna array layers. This results in acceptable performance of the lower frequency antenna array layers.

The stacked, multi-band antenna of the instant invention, however, places the highest frequency antenna elements at the bottom of the stack with the lower frequency elements in front. In fact, the rear, high frequency element may serve as a ground plane for the front, lower frequency antenna. There are three major differences between the inventive antenna and that of WONG, et al. First, the arrangement of the frequency layers is different. The inventive antenna has the lowest frequency band antenna layer at the outermost layer, but WONG, et al. put the highest frequency antenna at the outermost layer. The second difference is that WONG, et al. requires a "wirescreen" ground plane for every layer of antenna. In other words, there must be five ground plane screens if there are five frequency bands of operations. In the inventive antenna, only one ground plane is required for two or more layers (i.e., frequency bands of operation). The third point of difference is that in the WONG, et al. antenna, the polarization of all layers may only be linear. In addition to this limitation, the two junction layers must be transposed linearly polarized antennas. That is, if layer number two is an X-polarized antenna element, then layers number one and three must be Y-polarized antenna elements. The inventive antenna has not such constraint on the polarization of individual layers. For example, it can simultaneously perform as single or dual linear polarized antennas or as a circularly polarized antenna.

Still another approach to a multi-band antenna is disclosed in U.S. Pat. No. 5,982,339 for ANTENNA SYSTEM UTILIZING A FREQUENCY SELECTIVE SURFACE, issued to Farzin Lalezari, et al. LALEZARI, et al. use antenna elements having frequency selective surfaces (FSS) aligned in front of one another. The FSS of the front-most antenna element is designed to absorb a high frequency signal to which the antenna element is responsive, while making the elements appear transparent to lower frequencies to which one or more lower (rearward) antenna elements are tuned.

SUMMARY OF THE INVENTION

In accordance with the present invention there is provided a stacked, multi-band antenna system consisting of a low-frequency, forward portion and a gridded, rear portion designed for operation at a higher frequency. Both front and rear antenna sections may share a common ground plane or the rear antenna section may form a ground plane for the front antenna. Typically, the front antenna is a relatively narrow-band, gridded, bow-tie dipole and the rear antenna is a wide-band dipole or slot element. Additional frequency bands may be designed into the inventive system by adding additional dipole or similar antenna elements either in front of, between, or behind the front and rear antennas. By properly choosing element sizes and spacings, a frequency band ratio of as little as 4:1 can be accommodated.

It is therefore an object of the invention to provide a stacked, multi-band antenna system having a small ratio between operating frequency bands.

It is another object of the invention to provide a stacked, multi-band antenna wherein a high-frequency portion of the antenna is located being and in line with a low frequency portion of the antenna.

It is a still further object of the invention to provide a stacked, multi-band antenna where a low-frequency, front portion of the antenna may use the rearward, high-frequency portion of the antenna as a ground plane.

It is yet another object of the invention to provide a stacked, multi-band antenna wherein a front portion, a rear portion, or both portions of the antenna system are arrays.

It is a still further object of the invention to provide a stacked, multi-band antenna in which at least one of the antenna arrays is steerable.

It is an additional object of the invention to provide a stacked, multi-band antenna that may be combined into an antenna array.

One object of the invention is a stacked, multi-band see-through antenna, comprising a ground plane, and a first radiating element spaced a predetermined distance from the ground plane along a transmission/reception direction, wherein the first radiating element is tuned to a first operating frequency. The invention further comprises a second radiating element disposed along the transmission/reception direction and intermediate the first radiating element and the ground plane. The second radiating element is tuned to a second operating frequency that is greater than and in the range of four times the first operating frequency.

Another object is a stacked, multi-band see-through antenna, wherein the transmission/reception direction is substantially perpendicular to the ground plane.

An additional object includes a stacked, multi-band see-through antenna, further comprising RF signal feed means operatively connected to both the first and the second radiating elements.

Yet a further object is the stacked, multi-band see-through antenna, wherein the RF signal feed means comprises a first RF signal feed means operatively connected to the first radiating element and a second, independent RF signal feed means operatively connected to the second radiating element. And, the stacked, multi-band see-through antenna, wherein the RF signal feed means comprises a common RF signal feed means operatively connected to both the first radiating member and the second radiating element.

Another object is the stacked, multi-band see-through antenna, wherein the RF signal feed means comprises at least one from a group of devices: balun, splitter and filter.

A further object is the stacked, multi-band see-through antenna, wherein the first radiating element comprises a dipole array. Alternatively, the stacked, multi-band see-through antenna, wherein the second radiating element comprises a slotted array.

An additional object is for the stacked, multi-band see-through antenna, further comprising a first spacing means disposed between the ground plane and the second radiating element for supporting the second radiating element a predetermined distance from the ground plane. Also, for a second spacing means disposed between the first and the second radiating elements for supporting the first radiating element a predetermined distance from the second radiating element.

Another object is the stacked, multi-band see-through antenna, wherein the second radiating element is angularly disposed in relation to the first radiating element. Angularly disposed refers to the orientation of certain wires of the layers being positioned about 45 degrees relationship from the underlying layer in order to accommodate a dual band system.

Yet a further object is a stacked, multi-band see-through antenna, further comprising one or more radiating elements interspersed about said first and second radiating elements. As defined herein, interspersed refers to positioning one or more additional radiating elements above, below or between either of the first and second radiating elements, thus forming stackable layers of radiating elements.

An object of the invention is a stacked, multi-band, see-through antenna, comprising a ground plane having a front and a rear surface, with a first spacer means having a front and a rear surface, the rear surface of the first spacer means being disposed on the front surface of the ground plane. There is a first substantially planar radiating element adapted for operation at a first frequency and having a front and a rear surface, the rear surface of the first radiating element being disposed on the front surface of the first spacer means. A second spacer means having a front and a rear surface, the rear surface of the second spacer means being disposed on the front surface of the first radiating element. There is a substantially planar second radiating element adapted for operation at a second, predetermined frequency, the second frequency of operation being lower than the first frequency of operation, the second radiating element having a front surface and a rear surface, with the rear surface of the second radiating element being disposed on the front surface of the second spacer means.

And yet another embodiment is the stacked, multi-band, see-through antenna, wherein the first and the second spacer means comprise foam.

An object includes the stacked, multi-band, see-through antenna, wherein the first operating frequency and the second operating frequency are in a ratio of approximately 4:1.

Yet a further object, the stacked, multi-band, see-through antenna, further comprising a resonant cavity proximate the front surface of the ground plane.

Another object is the stacked, multi-band, see-through antenna, further comprising signal feed means adapted to feed an RF signal to the first radiating element and to the second radiating element.

An additional object is the stacked, multi-band, see-through antenna, wherein the first radiating element comprises a slot array. Also, wherein the second radiating element comprises a dipole array.

A final object of the invention is the multi-band, see-through antenna, wherein the first frequency of operation comprises an S-band frequency in the range of approximately 2.0–4.0 GHz.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Figure 1A:
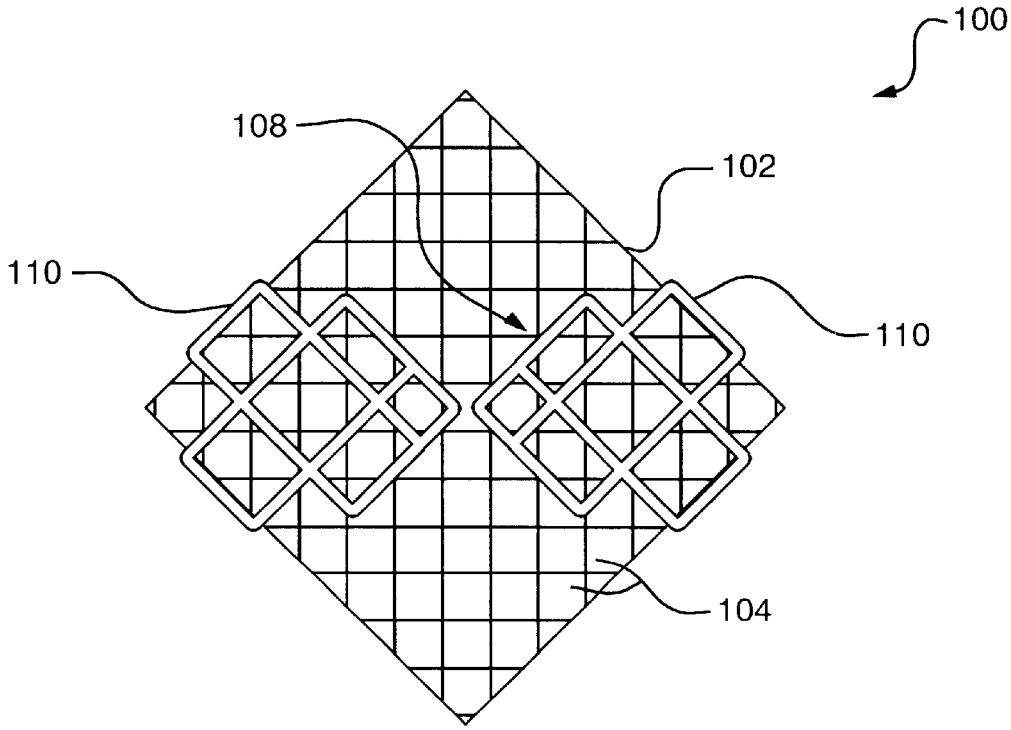
FIG. 1*a* is a schematic , top view of a simple embodiment of the stacked, multi-band antenna of the invention.
Figure 1B:
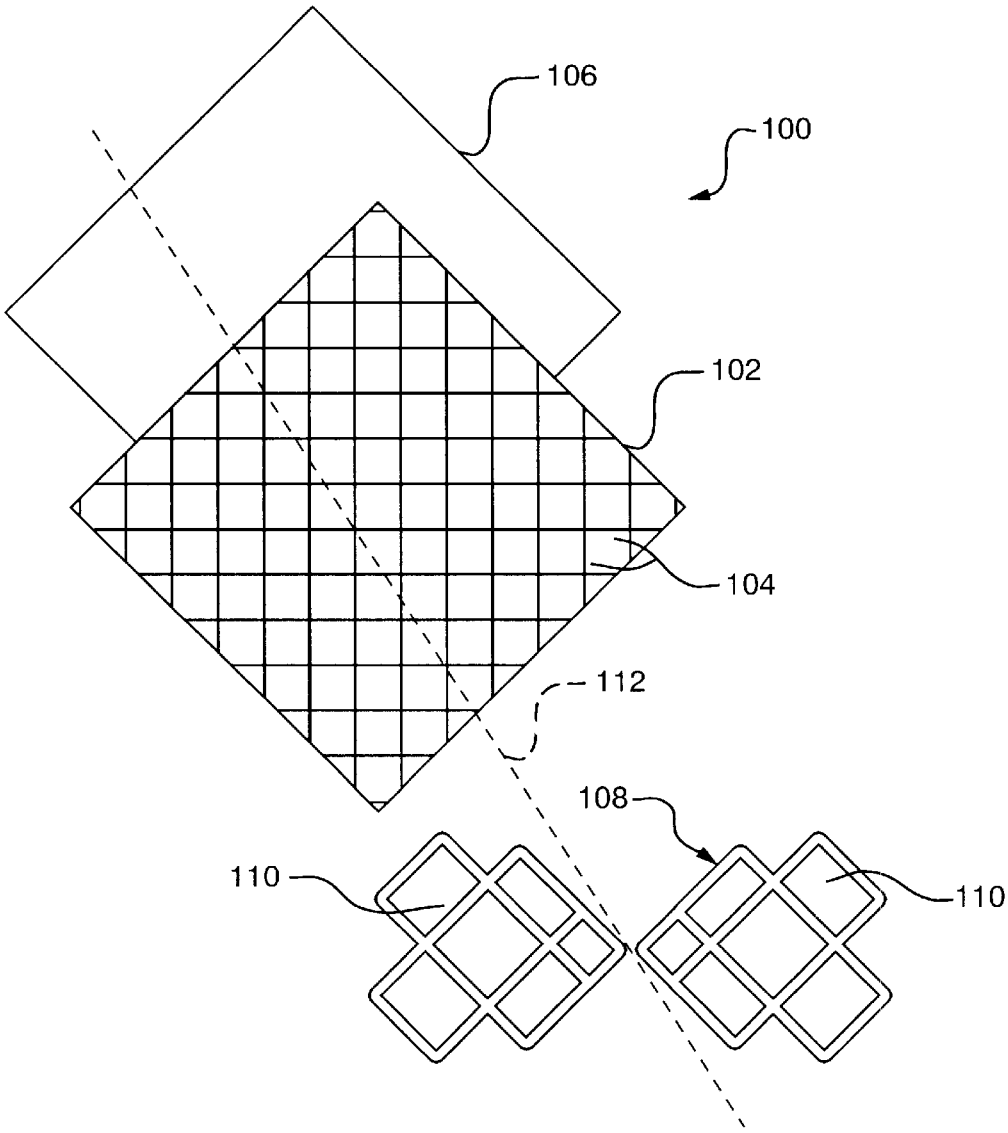
FIG. 1*b* is an exploded, perspective view of the antenna shown in FIG. 1*a;*

The present invention features a stacked, multi-band antenna system operable in at least two frequency bands having frequency ratios of as little as 4:1. Referring first to FIGS. 1*a* and 1*b*, there are shown schematic, top and exploded perspective views of a simple embodiment of the inventive antenna, generally at reference number 100. A rear (bottom), high-frequency antenna 102 is configured as a wide-band, gridded, fat dipole designed for operation in the S-band (i.e., approximately 2.0–4.0 GHz). The elements of antenna 102 are meshed or screened in a pattern 104 selected to provide proper operation at the frequency band of interest, while appearing essentially transparent to lower frequencies. A ground plane 106 is disposed behind antenna 102. A low frequency antenna 108, formed from two low-frequency, bow-tie dipole elements 110, is located in front of antenna 102 along a transmission/reception line 112.

Because antenna 102 is formed in a mesh pattern 104, it is essentially invisible to the low frequency handled by antenna 108. That is, antenna 102 does not interfere with the relationship of low-frequency antenna 108 and ground plane 106. Consequently, the ground plane 106 may function as a common ground plane to both antennas 102 and 108.

The mesh pattern 104 is designed according to the frequency of operation, and calculating the resonant length of the dipole or slot elements of the antenna 102 for that frequency. The next step is to orient the low-frequency antenna 108 on top of the high-frequency layer 102. Because it is a dual band system, the top layer 108 and the bottom layer 102 are placed at some angular displacement. In the preferred embodiment each element of the top low-frequency antenna 108 crosses the lower high-frequency antenna at 45 degrees. The placement of the crossings and the orientation of the low-frequency antenna 108 onto the high-frequency antenna 102 enable the 4:1 operation.

The layout of the structures is one of the important attributes of the present invention. Referring to the low-frequency antenna 108, the radiation pattern is dominated by the outside wires of the structure and the current flows primarily in the outer wires. The inner wires of the low-frequency antenna primarily control the impedance matching. In a preferred embodiment, the main outer wires are angularly disposed at about 45 degrees with respect to the underlying layer. The inner wires are oriented to eliminate blockage from the lower array. The layout or design is according to the underlying layer configuration, as the lower array may not be uniform.

Figure 2:
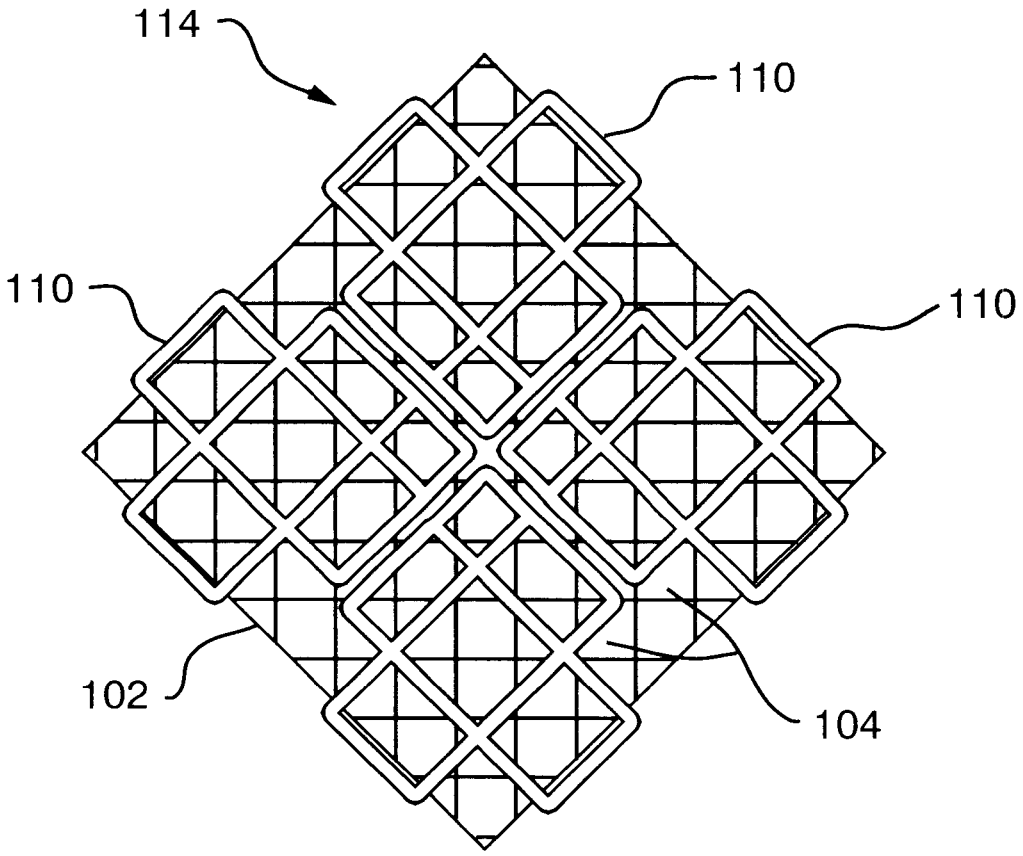
FIG. 2 is a schematic, top view of an alternate embodiment of the antenna shown in FIG. 1*a*.

Referring now also to FIG. 2, there is shown an alternate embodiment of the antenna of FIGS. 1*a* and 1*b*, generally at reference number 200. High-frequency antenna 102 is identical to high-frequency antenna 102 of FIGS. 1*a* and 1*b*. Low-frequency antenna 114 is constructed from a pair of crossed bow-tie elements 110.

The antennas of FIGS. 1*a*, 1*b* and 2 are shown to illustrate the concept of a stacked antenna. No signal feed means has been shown. Generally speaking, a feed line supplying or accepting a transmitted or received signal would be provided, as is well known to those skilled in the antenna design arts. The transmission line would convey a signal to or from a transmitter or receiver. Both high-frequency antennas 102 and low-frequency antennas 108, 114 could be fed from a single transmission line, provided that appropriate frequency splitters or filters (not shown) are used. The use of filters, etc. is well known to those skilled in the antenna arts and forms no part of the instant invention. Alternatively, a second transmission line (not shown) could be used to feed the low-frequency bow-tie elements 108, 114.

Figure 3:
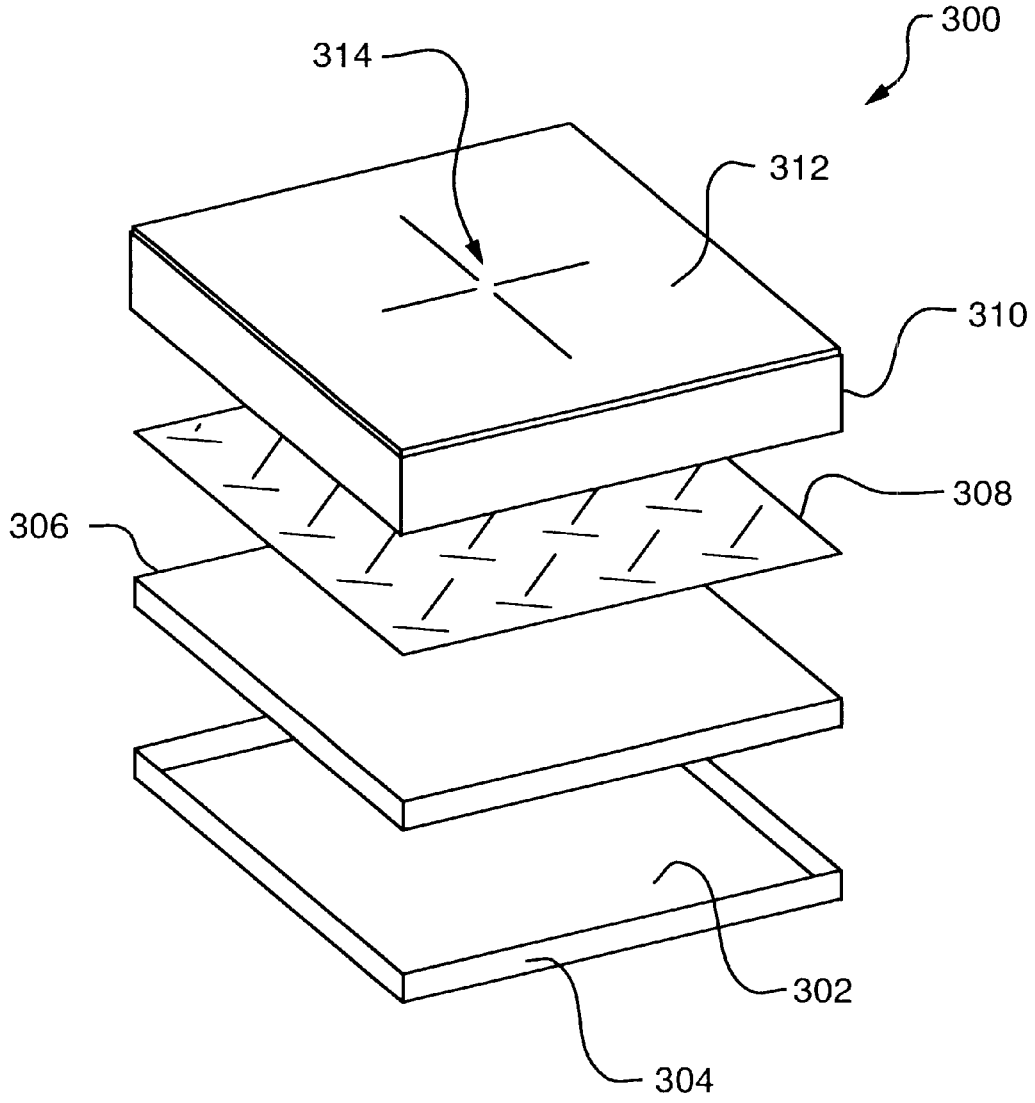
FIG. 3 is an exploded, perspective view of a practical implementation of the stacked, multi-band antenna of the invention.

Referring now to FIG. 3, there is shown an exploded, perspective view of a practical configuration of the inventive stacked, look-through antenna structure, reference number 300. A ground plane 302 is formed as part of a resonant cavity 304. Cavity 304 may contain the necessary feed structure, including one or more baluns (not shown) as may be required for a particular application or implementation. A foam spacer 306 separates resonant cavity 304 from a slot array 308 forming the high-frequency radiating structure. The physical structure of array 308 is designed to perform adequately at the chosen radiating frequency and be "invisible" to the low frequencies to which the upper, low-frequency radiating structure 314 is tuned. A second foam spacer 310 separates slotted array 308 from a dipole array 314 on the top surface 312 of foam spacer 310.

In this embodiment chosen for purposes of disclosure, both high and low-frequency elements 308, 314, respectively, share common ground plane 302. In alternate embodiments, high-frequency antenna elements could be utilized as a ground plane for low-frequency antenna element 314.

Figure 4:
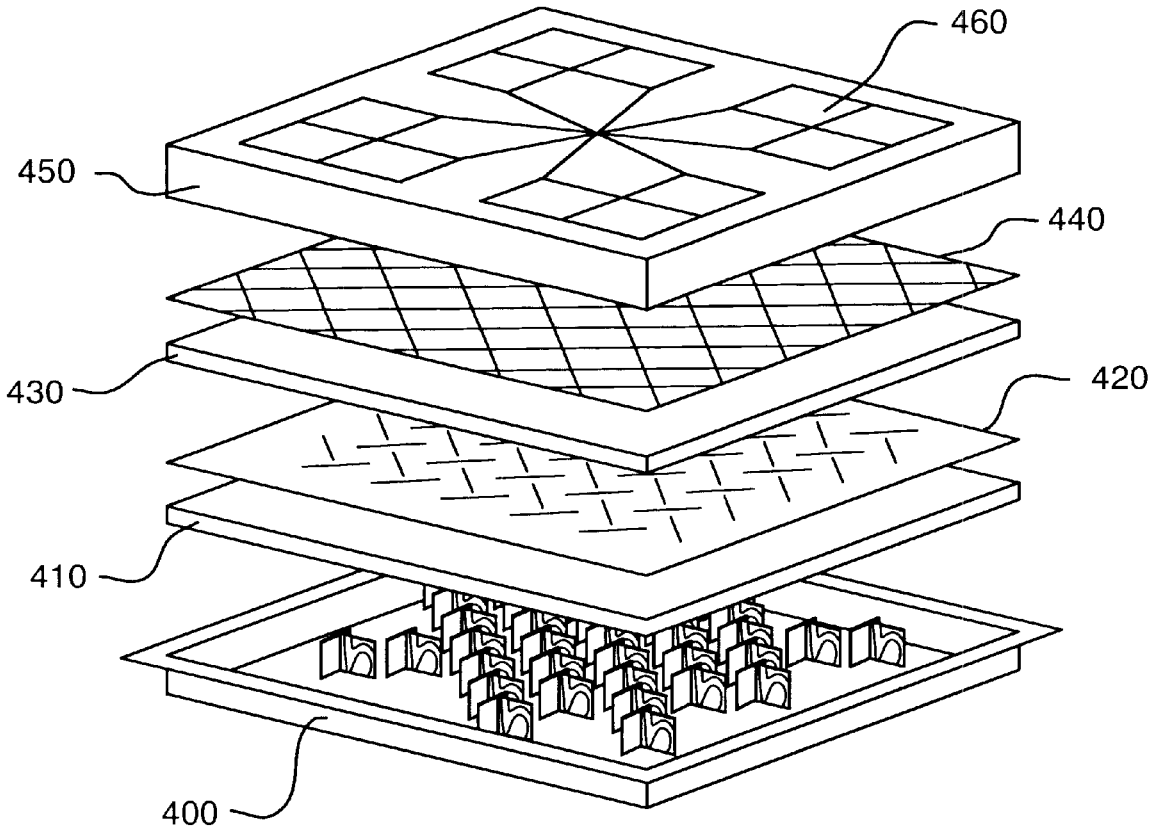
FIG. 4 is a multi-layer planar antenna showing a ground plane and a slotted planar array, mesh pattern layer, and a bow-tie element wherein each layer is separated by a spacer.

A multi-layer planar structure having multiple radiating elements is depicted in FIG. 4. The ground plane with the signal feed means is established on a lower planar layer 400. Spacer 410 separates the ground planar layer 400 and provides support for the slotted planar layer 420. There is another spacer 430 between the slotted layer 420 and the mesh pattern layer 440. Finally, the bow-tie elements 460 cap off the multi-layer antenna with the uppermost layer 450 properly oriented over the mesh pattern 440. Note that the spacers 410, 430 are optional.

Figure 5B:
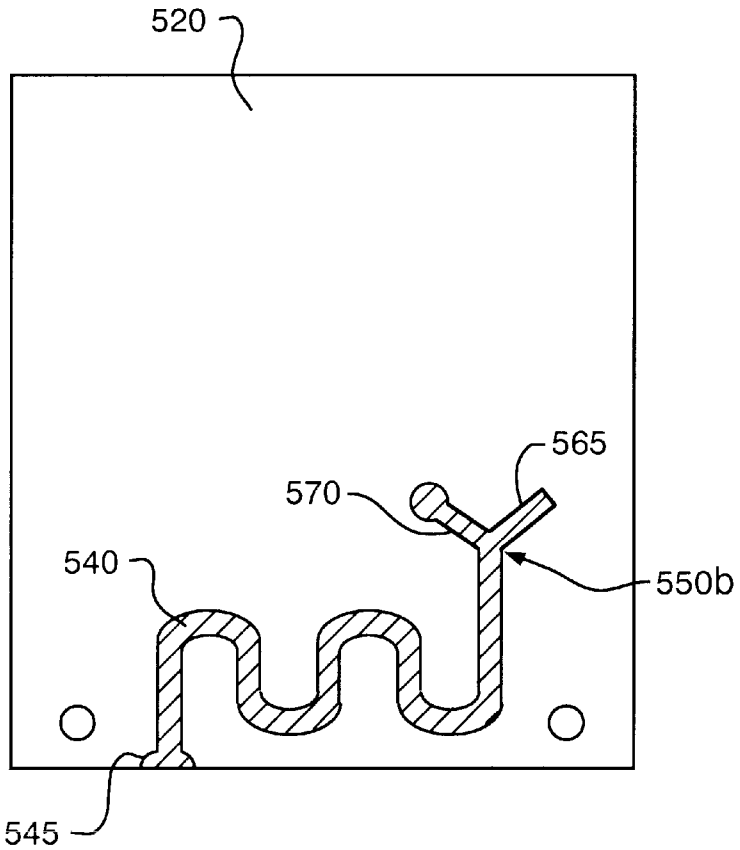
FIG. 5*b* is a bottom plan view of the flexible, stripline balun of FIG. 5*a;*
Figure 5A:
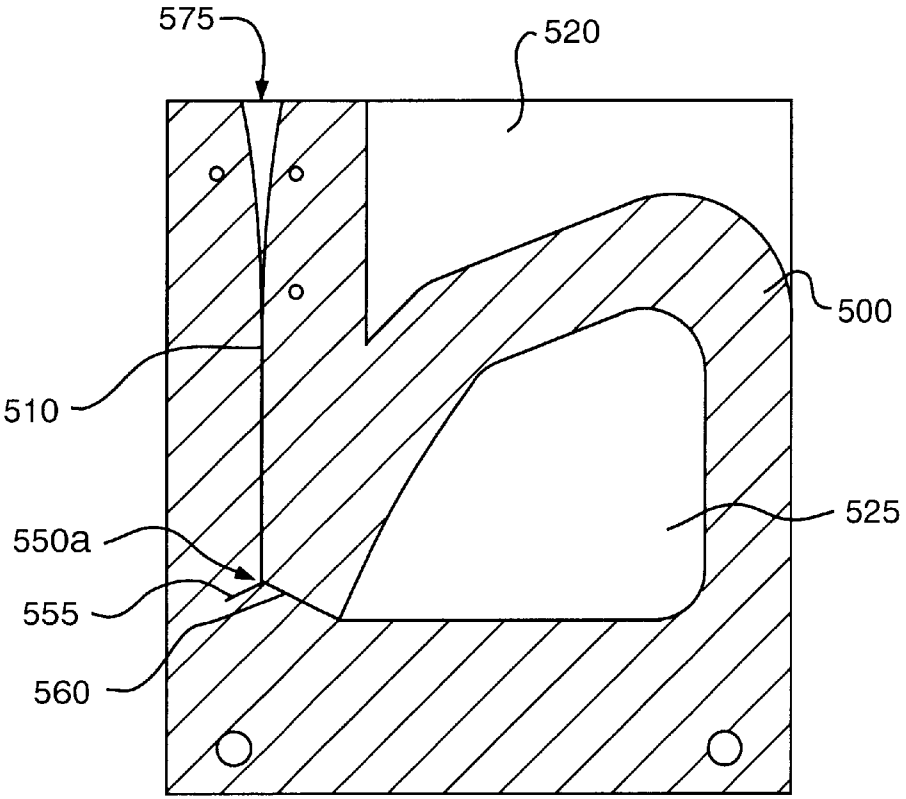
FIG. 5*a* is a top plan view of the flexible, wideband stripline balun in accordance with the invention.
Figure 5D:
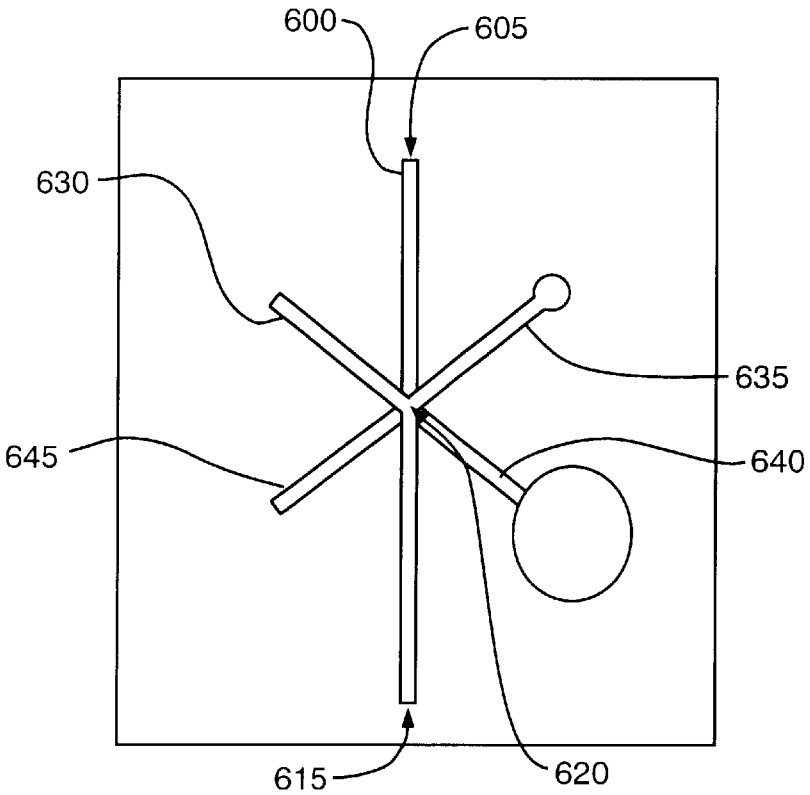
FIG. 5*d* shows a schematic view of a generalized six-port network with no meander lines.
Figure 5C:
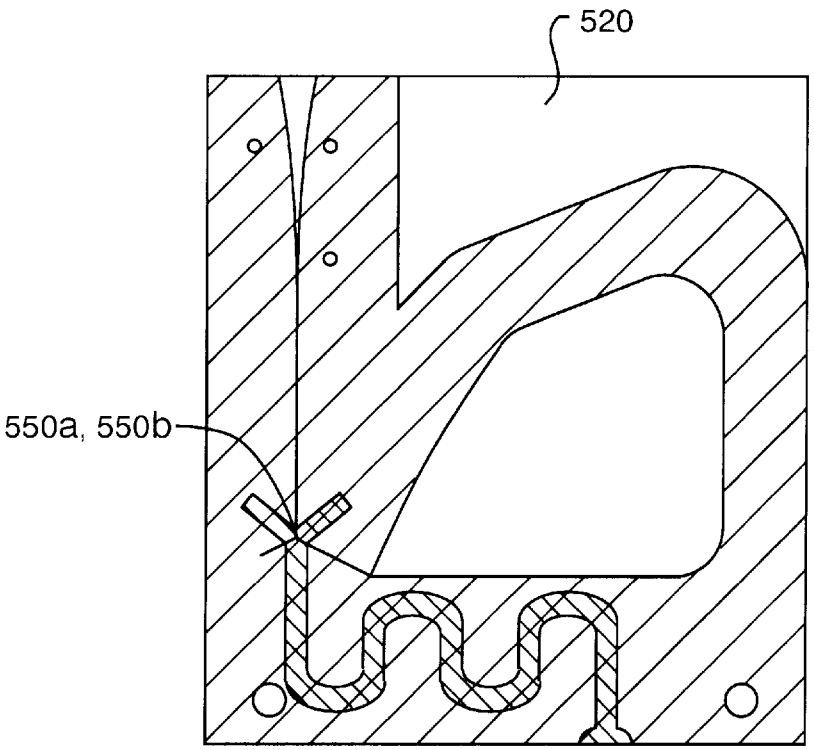
FIG. 5*c* is a composite view of the flexible, wideband stripline balun of the invention.

Referring now to FIGS. 5*a*, 5*b* and 5*c*, there are shown front and back plan views as well as a composite view of one embodiment of a balun. A thin substrate 520, typically 10 mil FR4 material, supports metallized patterns 500, 540 disposed on both the front and back sides of substrate 520, respectively.

On the front side of substrate 520 (FIG. 5*a*), there is a relatively large amount of metallized pattern 500, typically copper. A slotline 510 etched in metallized pattern 500 extends from junction 550*a* to a terminus 575. Slotline 510 may be flared in the vicinity of terminus 575 either to act independently as an antenna or to facilitate coupling to an attached radiating element (not shown) to which the balun may be coupled. Typically, terminus 575 may be coupled to any type of balanced radiating elements such as dipoles, slots, spirals, log-periodics, etc. A short-circuited slotline branch 555 and an open-circuited slotline branch 560 are electrically connected to and radiate from junction 550*a*. Open circuit slotline branch 560 is a meander line that defines a relatively large irregular space 525.

On the back side of substrate (FIG. 5*b*), an input pad 545 allows for the connection of an external, unbalanced transmission line (not shown) to a micro stripline 540 which terminates at junction 550*b*. The micro stripline 540 is a meander line, which allows a smaller balun to be constructed. An open circuit stub leg 565 and a short-circuited stub leg 570 are electrically connected to and radiate from junction 550*b*.

FIG. 5*c* shows a perspective composite view of the first and second sides of FIG. 5*a* and FIG. 5*b*, and the corresponding elements. Junction points 550*a* and 550*b*, are located on opposite surfaces of substrate 520, are aligned directly over one another but are not directly electrically connected.

FIG. 5*d* depicts an exploded view of a generalized six-port network without the meander line structures shown in FIG. 5*a*, 5*b*, 5*c*. The stripline 610 feeds a signal from an input 615 to a junction 620. A slotline 600 carries a balanced signal from junction 620 to a terminus 510. Open and short circuit stripline branches 630 and 635, respectively, are connected at junction 620. Likewise, open and short circuit slotline branches 640 and 645, respectively, are also connected to junction 620. This simple embodiment provides a compact, wideband, printed circuit slotline balun that achieves good impedance match and a low insertion loss across a wide operating band. Prior pending application by the same inventor application Ser. No. 09/845,998 filed Apr. 30, 2001 published on Nov. 22, 2001 as US 2001/0043128 A1 is incorporated by reference for all purposes.

What is claimed is:

1. A stacked, multi-band see-through antenna, comprising:

a ground plane;

one or more low-frequency elements spaced a predetermined distance from said ground plane, wherein low-frequency elements are comprised of a plurality of conducting wires, and wherein said low-frequency elements are fed from a first signal feed being tuned to a first operating frequency band; and a high-frequency element intermediate said low-frequency elements and said ground plane, said high-frequency element fed from a second signal feed being tuned to a second operating frequency band greater than said first operating frequency band, and wherein said low-frequency elements are oriented with respect to said high-frequency element such that one or more conducting wires of said low-frequency elements cross said high-frequency element at an angular displacement.

2. The stacked, multi-band see-through antenna according to claim 1, wherein said angular displacement is about 45 degrees.

3. The stacked, multi-band see-through antenna according to claim 1, wherein said low-frequency elements are selected from the group comprising: gridded bow-tie, solid bowtie, narrowband dipole, and conventional spiral.

4. The stacked, multi-band see-through antenna according to claim 1, wherein said high-frequency element selected from the group comprising: wide-band dipole and slot element, and conventional spiral.

5. The stacked, multi-band see-through antenna according to claim 4, further comprising:

a second spacer disposed between said low-frequency elements and said high-frequency element for supporting said low-frequency elements a predetermined distance from said high-frequency element.

6. The stacked, multi-band see-through antenna according to claim 1, wherein said first and second signal feed comprises a common signal feed operatively coupled to both said low-frequency elements and said high-frequency element.

7. The stacked, multi-band see-through antenna according to claim 1, further comprising:

a first spacer disposed between said ground plane and said high-frequency element for supporting said high-frequency element a predetermined distance from said ground plane.

8. The stacked, multi-band see-through antenna according to claim 1, further comprising an intermediate radiating element between said low-frequency elements and said high-frequency element at an intermediate frequency band between said first operating frequency band and said second operating frequency band.

9. The stacked, multi-band see-through antenna according to claim 1, further comprising a second high-frequency element between said high-frequency element and said ground at a third operating frequency band greater than said second operating frequency band.

10. A stacked, multi-band, see-through antenna, comprising;

a ground plane;

a substantially planar slotted radiating element adapted for operation at a first frequency;

a substantially planar mesh pattern radiating element adapted for operation at a second, frequency, said second frequency being lower than said first frequency, wherein said slotted radiating element is intermediate said mesh pattern radiating element and said ground plane; and one or more low-frequency elements adapted for operation at a third frequency, said third frequency being lower than said second frequency, wherein said mesh pattern radiating element is intermediate said slotted radiating element and said low-frequency elements, wherein said low-frequency elements are comprised of a plurality of conducting wires such that one or more conducting wires of said low-frequency elements cross said mesh pattern radiating element at an angular displacement of about 45 degrees.

11. The stacked, multi-band see-through antenna according to claim 10, further comprising a first spacer disposed intermediate said slotted radiating element and said ground plane maintaining a respective gap separation from said ground plane.

12. The stacked, multi-band see-through antenna according to claim 10, further comprising a second spacer intermediate said mesh pattern radiating element and said slotted radiating element maintaining a respective gap separation from said ground plane.

13. The stacked, multi-band, see-through antenna according to claim 10, further comprising a resonant cavity proximate said ground plane.

14. The stacked, multi-band, see-through antenna according to claim 10, further comprising a signal feed adapted to feed a first signal to said slotted radiating element, a second frequency to said mesh pattern second radiating element, and a third frequency to said low frequency elements.

15. The stacked, multi-band, see-through antenna according to claim 10, wherein said first frequency of operation comprises an S-band frequency in the range of approximately 2.0 to 4.0 GHz.

16. The stacked, multi-band, see-through antenna according to claim 10, wherein said first slotted radiating element acts as a ground plane for said mesh pattern radiating element.

17. A stacked, multi-band, see-through antenna, comprising:

a ground plane with a plurality of signal feeds;

a substantially planar first radiating element adapted for operation at a first frequency and coupled to said signal feeds;

a substantially planar second radiating element adapted for operation at a second frequency and coupled to said signal feeds, said second frequency being lower than said first frequency, wherein said first radiating element is intermediate said second radiating element and said ground plane;

a substantially planar third radiating element adapted for operation at a third frequency, said third frequency being lower than said second frequency, wherein said second radiating element is intermediate said first radiating element and said third radiating element, wherein said planar third radiating element is comprised of a plurality of conducting wires such that one or more conducting wires of said planar third radiating element cross said second radiating element at an angular displacement; and wherein said second radiating element uses said first radiating element as a ground plane.

18. The stacked, multi-band, see-through antenna according to claim 17, wherein said first, second and third radiating elements have separate signal feeds.

19. The stacked, multi-band, see-through antenna according to claim 17, further comprising spacers between said planar radiating elements maintaining a gap separation from said ground and said respective radiating elements.

* * * * *

UNITED STATES PATENT AND TRADEMARK OFFICE

CERTIFICATE OF CORRECTION

PATENT NO. : 6,452,549 B1
DATED : September 17, 2002
INVENTOR(S) : Zane Lo

It is certified that error appears in the above-identified patent and that said Letters Patent is hereby corrected as shown below:

Column 3,
Line 4, delete “being”, insert -- behind --

Column 7,
After line 30 insert:
-- Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims. --

Column 8,
Line 28, delete first “,” (after word “second”)

Signed and Sealed this

Twenty-third Day of March, 2004

JON W. DUDAS
*Acting Director of the United States Patent and Trademark Office*